United States Patent [19]

Peters et al.

[11] Patent Number: 4,881,637

[45] Date of Patent: Nov. 21, 1989

[54] HAT AND BOOT CASE

[76] Inventors: Jack Peters, 806 Eastwood Dr.; Jack T. Melton, 537 S. Cortez St., both of, Prescott, Ariz. 86303

[21] Appl. No.: 326,357

[22] Filed: Mar. 21, 1989

[51] Int. Cl.[4] ..... B65D 85/18

[52] U.S. Cl. ..... 206/278; 206/8

[58] Field of Search ..... 206/278, 8

[56] References Cited

U.S. PATENT DOCUMENTS

| | | | |
|---|---|---|---|
| 657,061 | 8/1900 | Cannan . | |
| 1,405,050 | 1/1900 | Levy . | |
| 1,896,761 | 2/1933 | Wheary et al. . | |
| 1,921,110 | 8/1933 | Wheary | 206/278 |
| 2,158,986 | 5/1939 | Peshek et al. | 206/278 |
| 2,638,192 | 5/1953 | Tuller . | |
| 3,749,232 | 7/1973 | Craig | 206/278 |
| 4,795,029 | 1/1989 | Campbell et al. | 206/278 |

*Primary Examiner*—Joseph Man-Fu Moy
*Attorney, Agent, or Firm*—Pollock, Vande Sande & Priddy

[57] ABSTRACT

An improved case particularly adapted for the safe and efficient storage and transportation of hats and boots, and in particular western style or cawboy hats and boots, is comprised of a single case preferably having two separate storage compartments, each of which is accessed throguh a separate door. One such compartment is designed to securely hold a hat, particularly a western or cowboy style hat. To achieve this result, a circular insert is provided which receives the top part of the hat thereby holding the hat in a fixed position while a strap, extending horizontally across parallel vertical sides of the box assures that the hat will not be jostled or damaged during transport. The second compartment contains straps along both sides which are intended to be used for securing boots and particularly western or cowboy style boots. Cutouts in an inner plate supporting the two compartments which comprise the case help hold each boot securely in place. On the inside of the door of this second compartment are strips upon which can be attached and detached small storage pouches such as miniature saddle bags.

11 Claims, 3 Drawing Sheets

HAT AND BOOT CASE

BACKGROUND OF THE INVENTION

There has been a long-standing need to provide a case which is capable of storing in a very efficient manner hats and boots, and in particular what are commonly known as western style or cowboy hats and boots such that these items may be stored and transported without damage to the items being transported and without unnecessary inconvenience to the transporter.

Existing cases frequently provide but a single storage compartment which increases the likelihood of contact between the items stored and thus increases the likelihood of those items becoming soiled, scuffed, or damaged.

Many conventional cases fail to provide a design whereby a particular portion of the case is permanently and readily identifiable as the bottom of the case. The result of this failure is that the sides, front, back, and top of such cases are likely to become scuffed, stained and battered.

Some existing cases provide a compartment for the storage of shoes or boots but fail to provide a means for securely holding the stored boots or shoes in place. Such design increases the likelihood of the boots or shoes becoming scuffed or otherwise damaged. Boots or shoes thus stored may also damage other items stored within the compartment or may damage the compartment's interior.

Similarly, existing cases fail to provide for the efficient and separate securing of a hat, and particularly of larger shaped hats such as the popular western style or cowboy hat.

While some existing cases provide for pouches for the carrying of papers or other personal effects, none provide the efficiency and convenience of detachable and removable compartments which can be reinserted and secured in the case.

The most efficient and convenient hat and boot case is one in which separate compartments, accessed through separate doors, are utilized to securely store a western or cowboy style hat and western or cowboy style boots. The most efficient and convenient of cases also includes an easily ascertainable top and bottom as well as detachable and removable pouches or saddle bags for convenience in packing and storing the users papers or personal effects.

BACKGROUND ART

Although U.S. Pat. No. 659,061 issued to Cannan discloses a hat box with two side opening doors, one of which includes a pouch for the storing of papers, the hat box depicted in that patent is incapable of holding boots or other such items because the majority of the second compartment is occupied with the cylinder which protrudes from the first compartment and is provided in the first compartment for the purpose of securing the hat to be stored in the box.

U.S. Pat. No. 2,638,192 to W. M. Tuller discloses a travel case suitable for storing and transporting conventional shoes and a hat. That travel case also includes in its interior a pouch for storing papers or the like. However, the configuration of the case disclosed in the '192 precludes the storage or transportation of western or cowboy style boots or the oversized western style hat.

Moreover, the travel case depicted in the '192 patent is comprised of only a single compartment.

A hat box comprised of two separate compartments is disclosed in U.S. Pat. No. 1,495,050 to Levy but access to these compartments is possible only through a single opening located at the top of the hat box. Moreover, the second compartment is not capable of holding larger items, such as western style boots.

Although a separate shoe compartment is provided in the hand luggage disclosed in U.S. Pat. No. 1,896,761 to Wheary, et al., the luggage suggested by that reference is little more than a traditional small suitcase with a separate shoe storage section which is created by a partitioning wall contained within the suitcase itself.

SUMMARY OF THE INVENTION

The foregoing needs and shortcomings are met and overcome by the present invention which provides a hat and boot storage and carrying case comprised of two separate and separately accessible storage compartments, one containing boot holding straps for properly securing boots during storage or transportation, and a second compartment which contains an oval hat holder attached to an oval block for securing a western or cowboy style hat.

The exterior of each of the two storage compartment doors can be covered with any one of a variety of distinctive textures or fabrics thus allowing for the creation of individual or unique design for use on different carrying cases.

The carrying case of the present invention also includes, within the boot compartment and specifically, on the interior side of the boot compartment door, detachable pouches or saddle bags for the purpose of storing papers or personal effects. The detachable and thus portable nature of these pouches or saddle bags allows for greater convenience in the packing of personal effects as well as in quickly and conveniently removing those personal effects from the carrying case.

The present invention also includes an inner plate which provides greater construction strength to the carrying case in that the inner plate is ridgedly secured to all walls of the case.

According to the present invention, less likelihood exists that the case would be scuffed, stained or battered during use because the two compartment doors open sideways and require carrying the case from the top portion.

Another advantage of the present invention is that the boot carrying compartment contains a cutout section such that the boot, at its widest section, specifically that located at the outside of the foot between the heel and toes, is wedged or placed into the opening created by the cutout section in the storage compartment wall, thereby holding the boot in a secure or "locked in" position. A similar boot cutout is provided for the purpose of securing or locking in the second boot.

The foregoing features, objects, and advantages of the present invention will become more apparent from the following detailed description which proceeds with reference to the accompanying drawings.

DESCRIPTION OF THE PREFERRED EMBODIMENT(S)

Figure 3:
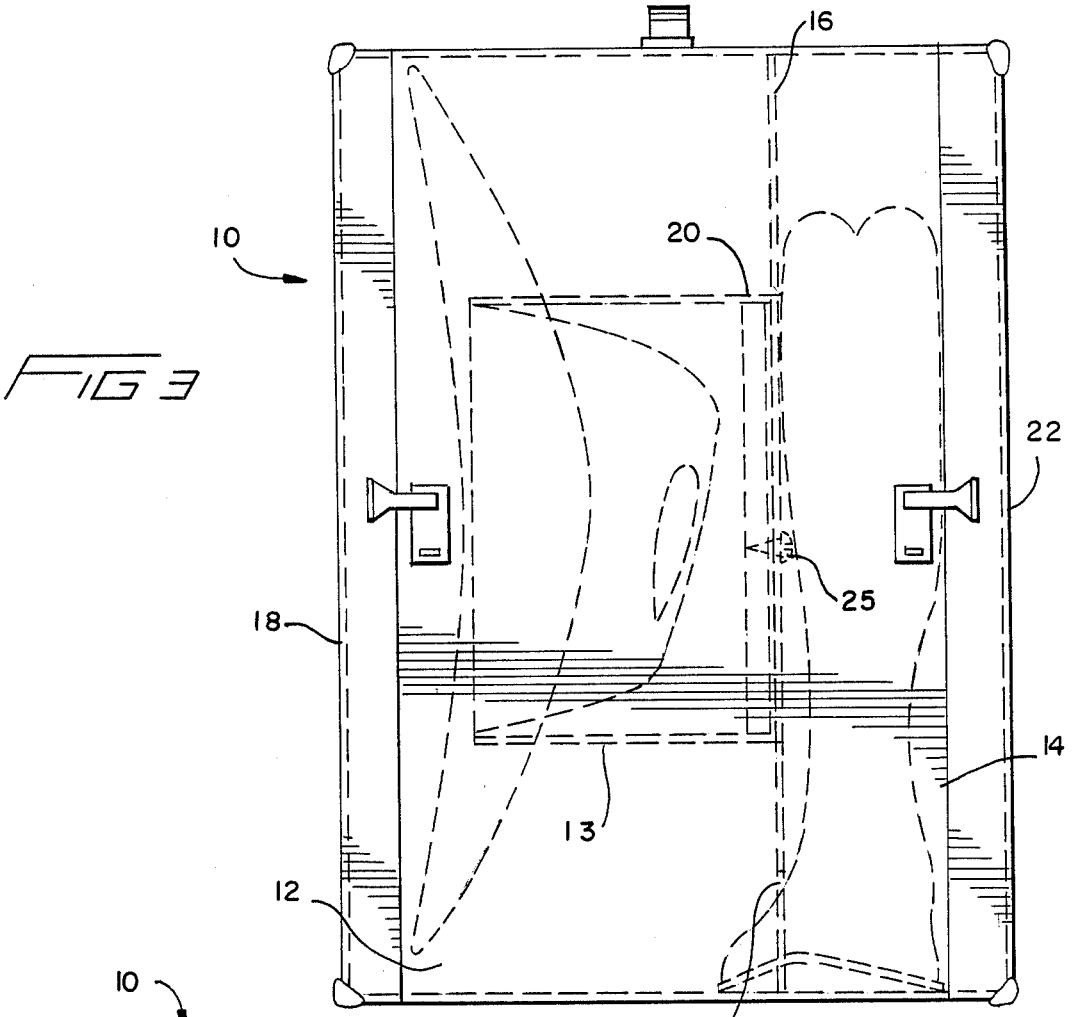
FIG. 3 is a vertical cross-sectional view of the present invention showing the occupied interior of both compartments of the carrying case when in a closed position.

Referring first to FIG. 3, the overall case 10 includes two separate compartments 12, 14 defined by top, bottom, and side walls and separated one from the other by an inner plate 16 which provides an interior vertical partition to securely hold an oval block 20 which in turns becomes the attachment block for the oval tube hat holder 13 in the hat compartment 12. Both of the storage compartments 12, 14 are depicted in FIG. 3 in an occupied condition. The hat compartment 12 is accessed through its own door 18 and the oval tube hat holder 13 located within that compartment receives and holds secure the top portion of the hat.

The second compartment 14 allows for the secure storage of a pair of boots, each of which is securely held in place by a boot holding strap 19, 21. (See FIG. 4). Additionally, each boot is securely held in place by the protrusion of the wide portion of the lower part of the boot through a cutout section 17 located in the inner plate 16 of the carrying case 10. Each of the two boot cutouts 17 located in the inner plate 16 allows only the wide portion of each boot to protrude through the cutout and into the hat compartment 12. The boot cutout 17 thus functions not only to secure the boot in place but also allows the boot compartment 14 to be narrower in width than would be the case if no such cutouts were provided.

Figure 2:
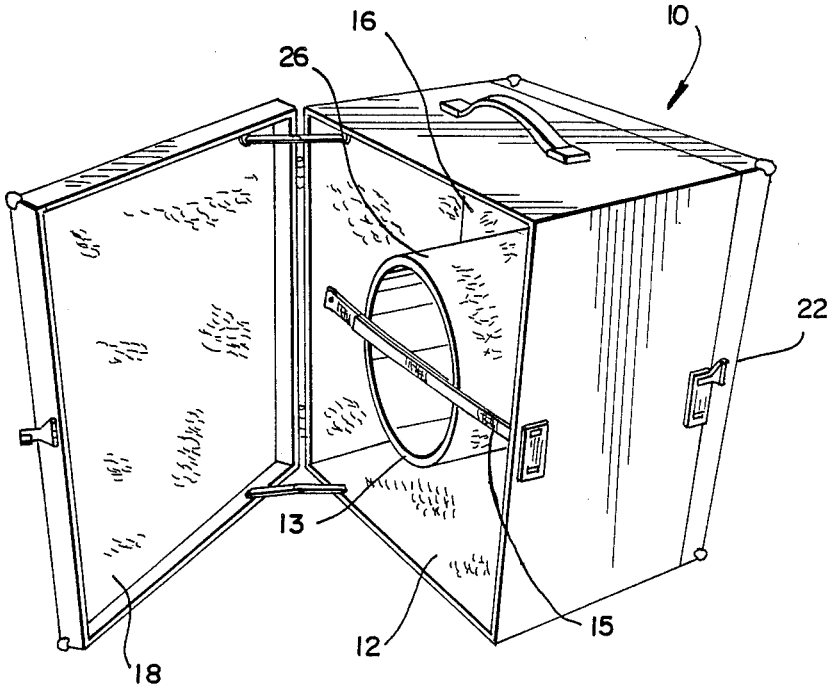
FIG. 2 is a perspective view of the carrying case with one compartment door open, specifically, the compartment provided for hat storage, revealing the hat holder and securing strap as positioned within that compartment.

Turning to FIG. 2, the separately accessible hat storage compartment 12 is shown in an unoccupied condition thus revealing the oval tube hat holder 13 which is securely affixed onto an oval block 20 which, in turn, is securely affixed onto the hat storage compartment side of the inner plate 16. A strap 15, securely fixed to one side wall of the hat compartment 12 transverses the interior of the hat compartment so as to securely hold in place the hat stored within that compartment. Both the oval block 20 and the oval tube hat holder 13 are covered with a fabric or other soft covering in order to prevent scuffing or damage to the hat when stored.

Once the oval tube hat holder 13 is fixedly attached to the periphery of the oval block 20, the block and the oval tube become a single hat mounting unit 26. The hat mounting unit may be then covered with the fabric prior to being connected to the inner plate 16 by the attachment screw 25 as shown in FIG. 3. Such simple structure including the single hat mounting unit removably attached to the inner plate of the hat compartment by the single screw 25 allows fast and easy removal and replacement of the hat mounting unit due to, for example its damage or for accommodation of a different size western hat.

Figure 4:
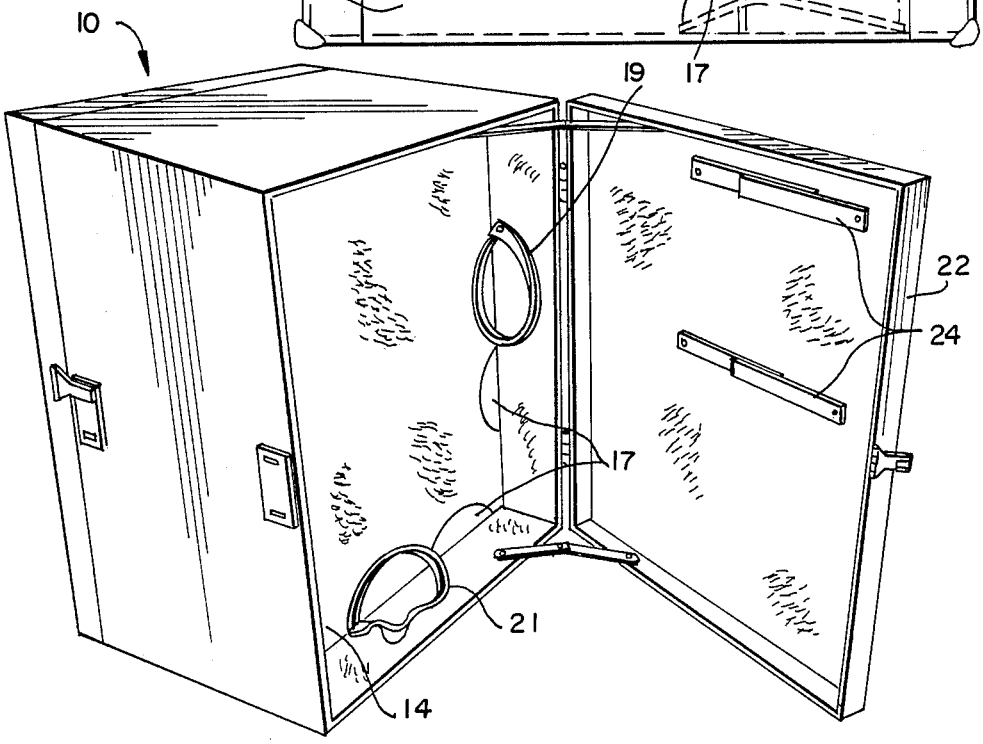
FIG. 4 is a perspective view of the present invention showing the carrying case with the boot compartment door open and the compartment unoccupied.

In FIG. 4, the boot storage compartment 14 is shown in an unoccupied condition. The boot storage compartment includes two boot holding straps 19, 21, one permanently attached to the bottom edge of the boot storage compartment and the other permanently attached to the right side edge of that compartment. On the interior wall of the boot compartment door are affixed multiple velcro strips 24 upon which can be attached and detached pouches or miniature saddle bags. (Shown in FIG. 5) The inside of the boot storage compartment, like the interior of the hat storage compartment, is covered with a protective fabric or padding.

Figure 5:
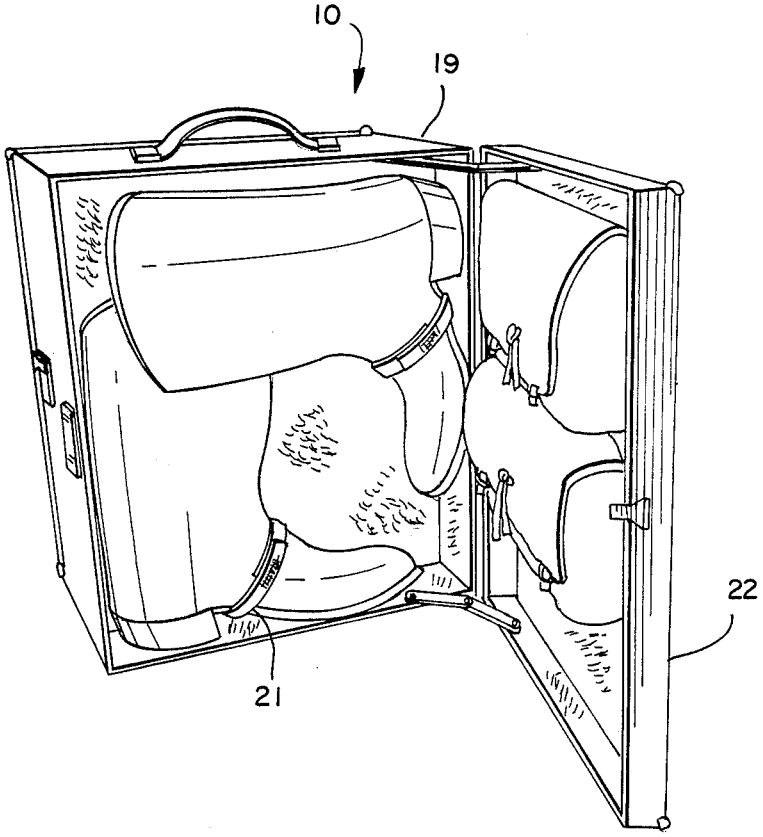

Boots held in place through the use of boot holding straps 19, 21 are shown in FIG. 5. The mounted pouches or miniature saddle bags provided for the storage of papers or personal effects are shown secured to the multiple velcro strips 24 referred to in FIG. 4.

Figure 1:
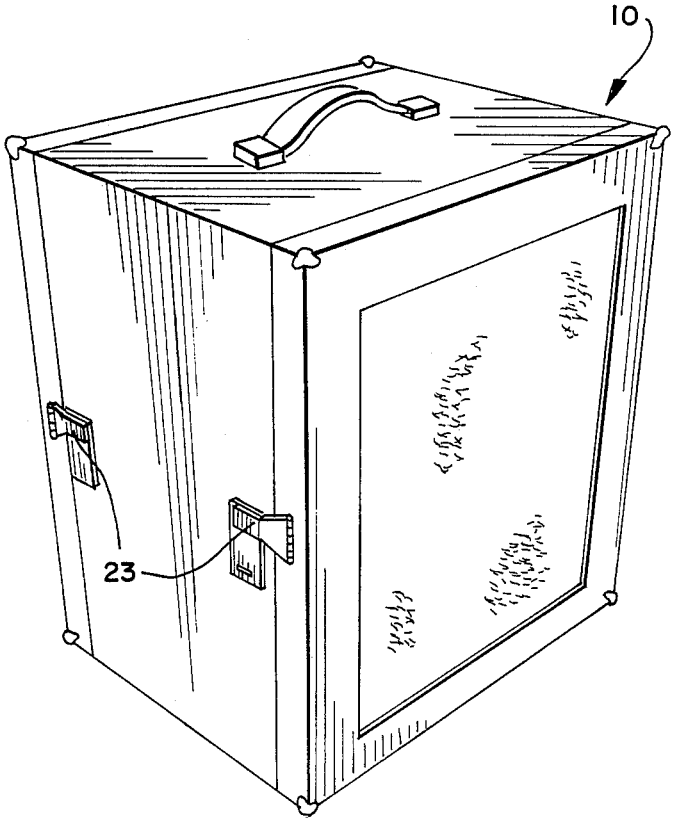
FIG. 1 is a perspective view of the carrying case comprising the present invention in its closed position.

The carrying case 10 comprising the present invention is shown in FIG. 1 in its closed position with each compartment door 18, 22 closed and secured by latch members 23. Rectangular inserts of different fabric, color, or design may be utilized on each compartment door section in order to provide different carrying cases with different and distinctively attractive appearances.

Having illustrated and described the principles of the present invention by what is presently the preferred embodiment, it should be apparent to persons skilled in the art that such embodiment may be modified in arrangement and detail without departing from such principles. We claim as our invention all such modifications coming within the true spirit and scope of the following claims.

We claim:

1. Means for carrying both boots and a hat comprising:

an enclosed container having an interior partition dividing said container into separate boot and hat storage compartments;

a pair of generally opposed parallel doors on opposite sides of said interior partition for providing selective access to said boot and hat compartments;

means for mounting said hat in said hat storage compartment, at least one aperture defined in said partition adjacent its edge for each boot to be stored in said boot compartment, said apertures permitting the widest portion of each boot to extend into said hat compartment.

2. The means according to claim 1 further comprising means for holding said boots in place in said boot storage compartment.

3. The means according to claim 2, wherein said boot holding means includes at least one boot holding strap fixed to one of the interior walls of said boot storage compartment for securing each of said boots in place in said boot storage compartment.

4. The means according to claim 1 further comprising means for attaching accessories to the interior wall of said boot compartment door.

5. The means according to claim 4, wherein said means for attaching includes at least one strip fixed to the interior wall of said boot compartment door.

6. The means according to claim 1, wherein said container is a rectangular parallelopipe.

7. The means according to claim 1, wherein said means for mounting said hat comprises an oval tube holder for holding a top portion of said hat provided in said hat compartment on the wall of said interior partition.

8. The means according to claim 7 further comprising means for securing said hat in place in said hat storage compartment.

9. The means according to claim 8, wherein said means for securing includes a hat securing strap having one end fixed to one of the side walls of said hat storage compartment and an opposite end detachably connected to another side wall of said hat storage compartment.

10. The means according to claim 7, wherein said oval tube holder is secured to an oval block to form a single hat mounting unit which is covered with a soft covering, said hat mounting unit being removably connected to the wall of said interior partition.

11. The means according to claim 10, wherein said hat mounting unit is connected to the wall of said interior partition by a single screw.

* * * * *